US006586893B2

(12) United States Patent
Shik

(10) Patent No.: US 6,586,893 B2
(45) Date of Patent: Jul. 1, 2003

(54) CONVERGENCE CORRECTION DEVICE FOR ELECTRON BEAMS IN COLOR PICTURE TUBE AND PROCESS OF USING

(76) Inventor: Song O Shik, 103dong-902ho, Woobang Mijin Haitz, 670 Bummul-dong, Susung-gu, Daegu-City (KR)

( * ) Notice: Subject to any disclaimer, the term of this patent is extended or adjusted under 35 U.S.C. 154(b) by 24 days.

(21) Appl. No.: 09/955,353

(22) Filed: Sep. 12, 2001

(65) Prior Publication Data

US 2003/0048065 A1 Mar. 13, 2003

(51) Int. Cl.[7] ..... G09G 1/28; H01J 29/50

(52) U.S. Cl. ..... 315/368.11; 315/368.27; 315/382.1; 315/382; 313/412; 313/428; 313/431

(58) Field of Search ..... 315/382, 382.1, 315/386, 364, 368.25, 368.26, 368.27, 5.24, 5.26, 5.34, 5.35; 313/412, 413, 421, 428, 430, 431

(56) References Cited

U.S. PATENT DOCUMENTS 5,838,099 A * 11/1998 Hichiwa et al. ..... 313/440
6,307,313 B1 * 10/2001 Fukuda ..... 313/421
6,373,202 B1 * 4/2002 Ito et al. ..... 315/370

* cited by examiner

*Primary Examiner*—Don Wong
*Assistant Examiner*—Tuyet T. Vo
(74) *Attorney, Agent, or Firm*—John J. Murphey

(57) ABSTRACT

A device for correcting residual mis-convergence errors in a color cathode ray tube, the tube including a narrow-necked section, located at the rear thereof, in which electron guns mounted therein generate forwardly-directed red, blue and green electronic beams, an outwardly-opening center skirt section, extending forward from the narrow-necked section, and terminating in a wide perimeter surrounding a relatively flat, pixel-coated, viewing screen section that is arranged generally orthogonal to the axis of the narrow-necked section and upon which the electronic beams are directed to strike the pixels to produce color and images for viewing from the front of the tube, and further having at least one pair of electromagnetic coils mounted outside the tube, for initial focusing of the electron beams during their travel from the guns to the screen, the device including a separator made of a plastic, including a high density of magnetizable particles therein, the separator arranged for placement about the outside of the tube and adapted to receive the electromagnetic coils thereon and, a plurality of small, powerful magnetic poles formed in the separator by at least one application of short-duration, high-voltage charges to various areas on the separator, the location of the magnetic poles determined by measuring the difference between the actual location on the viewing screen where the electron beams strike the pixels and the desired location where the beams are desired to strike the pixels and applying appropriate correction to the paths of the beams using the location and the strength of the magnetic poles.

12 Claims, 9 Drawing Sheets

| Angular pole position in degrees from the x-axis | Screen Location | Type of Blue Red Error |
|---|---|---|
| 0 | 3 and 9 | Δ Y |
| 30 | 3 and 9 | Δ X |
| 36 | 2, 4, 8 and 10 | Δ X |
| 54 | 2, 4, 8 and 10 | Δ Y |
| 60 | 6 and 12 | Δ X |
| 90 | 6 and 12 | Δ Y |

CONVERGENCE CORRECTION DEVICE FOR ELECTRON BEAMS IN COLOR PICTURE TUBE AND PROCESS OF USING

BACKGROUND OF THE INVENTION

1. Field of the Invention

This invention pertains to the field of television picture tubes and to a device for correcting residual mis-convergence errors in the cathode ray tube (CRT) or picture tube. More particularly, the invention concerns a novel device for adding to the deflection yoke in order to correct residual mis-convergence of the green, red and blue beams as they strike the pixels located on the inside of the face of the tube.

2. Description of the Prior Art

A cathode ray tube (CRT) or television tube generally comprises a narrow-necked section, located at the rear of the tube, in which electron guns mounted therein generate forwardly-directed electronic beams, an outwardly-opening center skirt section, where the beams are spread outward by magnetic forces, and a relatively flat, specially coated, viewing screen section at the front of the tube, lying generally orthogonal to the axis of the narrow-necked section and upon which the spreading beams strike to produce images (the television picture) for viewing from in front of the tube. The tube operates by directing the electronic beams of energy forward through the neck of the tube and flaring them onto the coating, known as phosphors or pixels, coated on the inside of the face or viewing screen located at the front of the tube. Color television sets and computer monitors use such a CRT and the pixels but require three different beams—blue, green and red. When these beams converge on the pixels they produce a color that is viewable from the front of the CRT, and this is the color that is seen by the viewer sitting in front of the television set or computer.

The three beams generated in guns located centrally in the narrow-necked section at the rear of the tube are initially maintained converged in the neck of the tube. The beams are then deflected and converged at all other points of the screen by a device known as a deflection yoke (DY). Typically, a deflection yoke consists of pairs of electromagnetic coils energized by electric currents to create magnetic fields for deflecting the beams in the horizontal direction and vertical direction. The coils comprise wound loops of small diameter copper wire. The pairs of coils are nestled in a plastic liner (or separator) which also serves to electronically insulate the two pairs of coils from one another. The DY controls the individual paths of the three beams as they traverse the screen, beginning at the top left corner of the screen and traveling across to the top right corner then repeating this travel on the next, lower line of pixels below that previously traveled and continue back and forth until the entire screen has been sprayed with the beams. This traversing action is accomplished hundreds of times per second, faster than can be discerned by the human eye, and thus is presented to the viewer as a complete screen full of colored objects moving about as in a play, a dance or a motion picture show.

While the electromagnets located on the separator are sufficient, both in intensity and in operation, to control the paths of the three beams generally in the center of the tube and throughout much of the flaring action, shifts occur in the paths of the three beams as they approach the extreme edges of the screen. This deflection results in some misalignment and mis-convergence of the three beams at the edges of the picture tube, dulling of the color and focus and generally degrading performance of the picture tube from producing high quality reproduction of what is intended to be presented.

At present, the prior art deals with this problem by having a workman energize the picture tube during the latter stages of television manufacture and assembly but after the picture tube has been totally constructed. He or she visually observes the misalignment or mis-convergence of the beam paths outward from the center of the tube. He or she then temporarily removes the yoke from around the narrow-necked portion of the tube, reaches a hand into the inner surface of the wire-wound coils, and applies small, short, flat strips of plastic ferrite, each having a high density of magnetic particles embedded therein, to the inner surface of the coils and covers the strips with adhesive tape. The tube, and yoke are then reassembled. These small strips later operate to distend the magnetic fields generated by the large electromagnetic coils in the yoke and this distention is intended to correct the mis-convergence visually perceived by the assembler.

The number and location of these small strips of "magnetic" tape are determined by the expertise of the person doing the testing and adding the tape to the magnets on the assembly line and carry the overriding problems of worker fatigue, off-the-job sickness, human temperament, and the like. In addition, removing and then replacing the yoke, after application of the small strips of tape, is a time-consuming practice that adds unnecessary cost to the television set assembly process resulting in lost profits.

An alternative prior art practice involves connecting small "auxiliary" coils in series or parallel with the main yoke coils in different circuit configurations in such a way that these auxiliary coils provide an additional magnetic field necessary to correct mis-convergence errors. Typically, these auxiliary coils are adjusted by a potentiometer or position of a ferrite core within the coil. Obviously, this is an expensive and time-consuming solution.

SUMMARY OF THE INVENTION

This invention is a device for correcting residual mis-convergence errors in a color cathode ray tube that may be assembled with the tube and later used to correct the mis-convergence without disassembling the tube or adding tape or extra wire-wound electromagnets to the tube assembly. The invention comprises a deflection yoke liner (separator) of an injection-molded plastic wherein the plastic includes a high density of magnetizable particles therein, where the separator is mounted about the CRT. A plurality of small, powerful magnets are formed in the magnetizable particles in the separator by application of short-duration, high-voltage pulses applied thereto from outside sources. The magnets are created and positioned on the separator from knowledge about the correlation between the magnets' location and maximum resulting effects on mis-convergence errors in the tube viewing screen and applying appropriate correction to the strength of the magnets.

The process of using the separator of this invention, to correct mis-convergence of electron beams in a color picture tube, includes the steps of first affixing the separator, containing at least one pair of deflection coils, about the picture tube, energizing the guns located inside the tube to generate the forwardly-directed electron beams, adjusting the electromagnetic deflection coils to obtain a tightly focused convergence of the beams as practical, measuring the residual mis-convergence errors on the screen, temporarily applying a plurality of small, electric magnetizing coils to various locations around the separator, wherein the locations are determined by application of an algorithm to counteract mis-convergence of the electron beams at locations not corrected by the larger electromagnetic coils, and applying iteratively single applications of short-duration, high voltage pulses to create small magnetic areas in the separator that will correct all the residual mis-convergence errors throughout the screen. The result is a CRT that does not require disassembling during production or the addition of hand-placed strips of magnetic tape or other handling that results in prolonged production time and loss of profits.

Accordingly, the main object of this invention is to streamline the final stages of correcting mis-convergence of the red, green and blue electron beams generated in the guns in the aft end of the picture tube so that the present practice of applying small bits of magnetic distorting tape to the large electromagnetic coils is eliminated. Other objects of the invention include a method that removes the human element from correcting mis-convergence of the electron beams in a CRT and replaces it with an automatic system that provides consistent results in a continuous manner not adversely affected by the fragilities of human intervention; a means of reducing assembly time in the color CRT industry by eliminating the step of dismantling the yoke on the neck section of a CRT; and a means of eliminating the need for specially trained, heavily experienced personnel in the steps of correcting mis-convergence in CRT assembly.

These and other objects of the invention will become more clear when one reads the following specification, taken together with the drawings that are attached hereto. The scope of protection sought by the inventors may be gleaned from a fair reading of the Claims that conclude this specification.

DESCRIPTION OF THE PREFERRED EMBODIMENT

Figure 1:
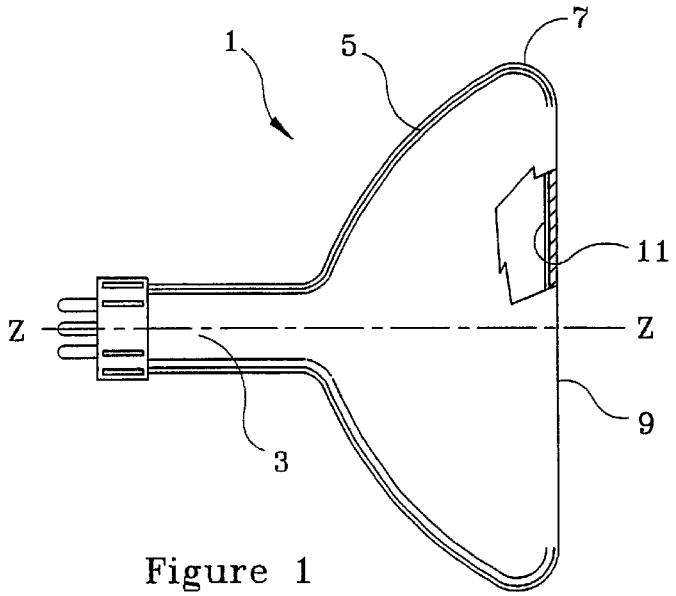
FIG. 1 is an illustrative view of a typical cathode ray tube used in color television set showing a small portion broken away to see the inside of the viewing screen.

Turning now to the drawings wherein elements are identified by numbers and like elements are identified by like numbers throughout the 10 figures, a typical cathode ray tube (CRT) or color television tube is shown in FIG. 1 to comprise a relatively large, hollow glass tube 1, including a narrow-necked section 3 located at the rear and extending toward the middle of tube 1, in which electron guns (not shown) are mounted therein for generating forwardly-directed red, blue and green electronic beams, an outwardly-opening center skirt section 5, extending from the narrow-necked section 3 and terminating in a perimeter 7 surrounding a relatively flat, pixel-coated, viewing screen section or front screen 9 that is arranged generally orthogonal to the axis of narrow-necked section 3. The interior of screen 9 is coated with electro-luminescent phosphors or "pixels" 11 upon which the red, blue and green beams strike to produce colored images for viewing from the front of tube 1.

Figure 2:
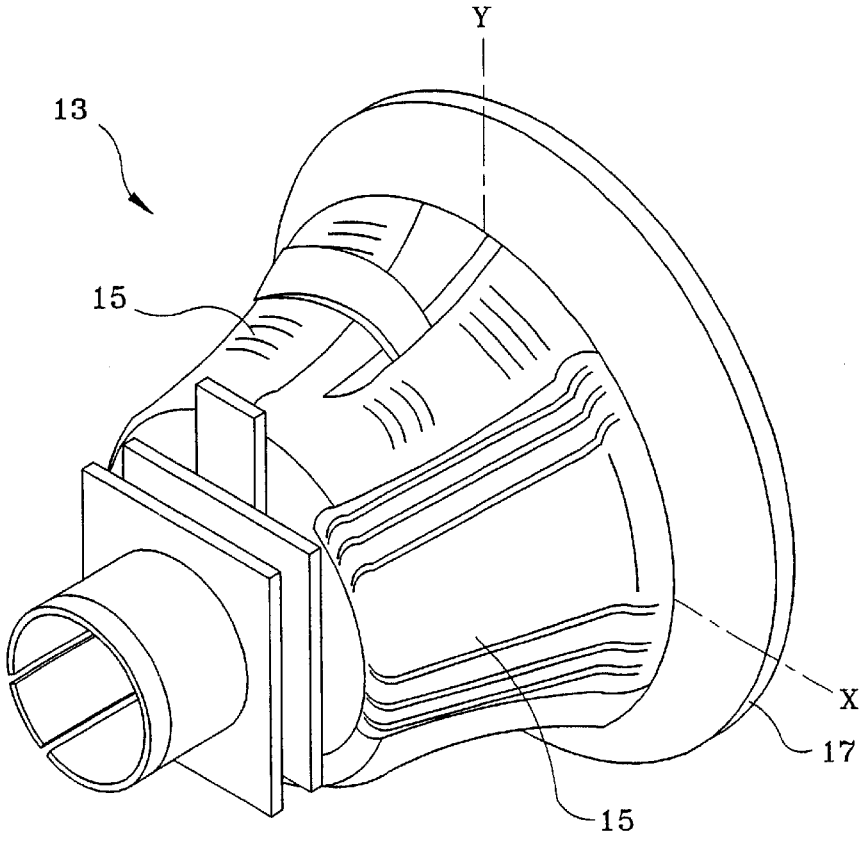
FIG. 2 is a perspective view of a typical focusing yoke used in the color television industry.

In addition, as shown in FIGS. 1 and 2, tube 1 may be further defined by "x" and "y" axes passing respectively horizontally and vertically across yoke 13 (and tube 1 to which it is attached) and intersecting at the geometric center of screen 9, as well as a "z" axis extending centrally from narrow-necked section 3 and intersecting the "x" and "y" axis at their intersection at the center of tube 1.

As shown in FIG. 2, the prior art CRT 1 has a deflection yoke 13 for placement slightly forward of narrow-neck section 3 on which are mounted at least one, but preferably a plurality, of large electromagnetic coils 15 comprising many windings of fine copper wire. Coils 15 are energized to create electromagnetic fields that deflect the three electron beams during their travel from the guns, through the interior of tube 1, to screen 9 thus producing the picture on tube 1.

Figure 3:
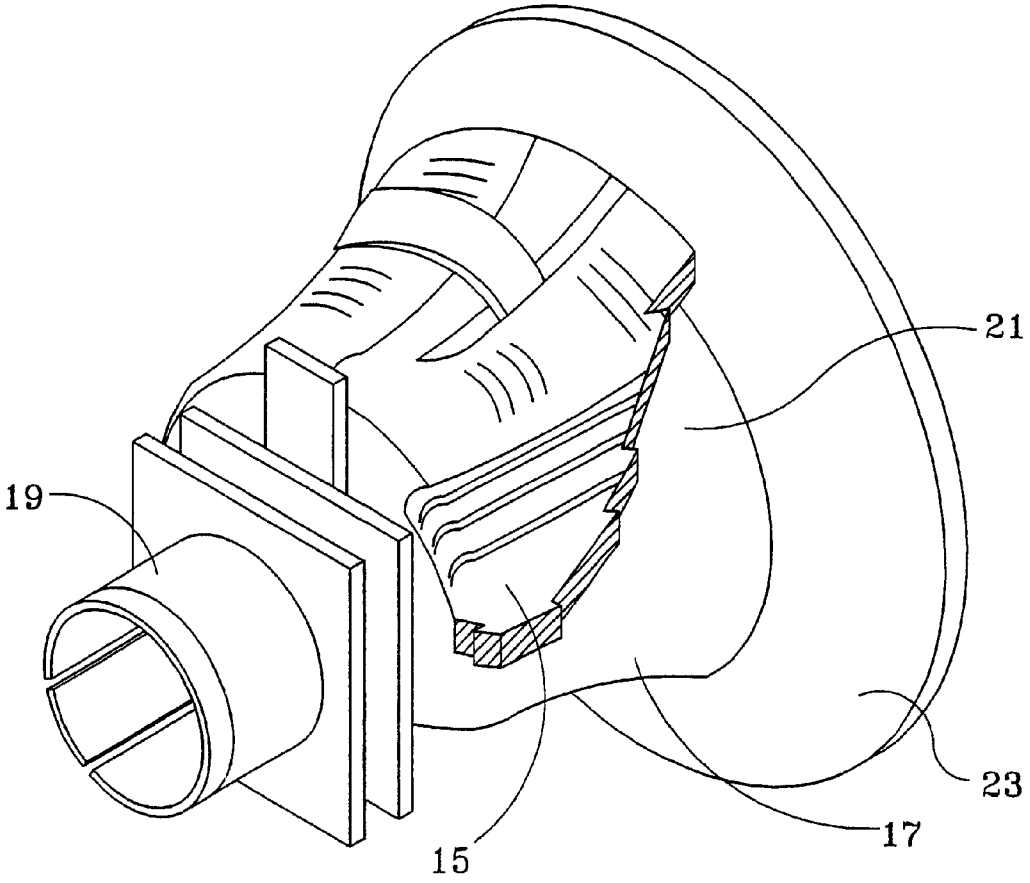
FIG. 3 is a perspective view of the separator used in this invention showing one of the electromagnetic coils, broken away, located on top of the separator.

FIG. 3 shows the preferred embodiment of the mechanical aspect of this invention. Shown therein is a special separator 17 that takes the place of the conventional plastic separator 17 of deflection yoke 13. Separator 17 is made of an injection-moldable plastic that includes a high density of magnetizable particles such as barium ferrite embedded in it. Coils 15 are mounted about it much the same as in the prior art version where coils 15 are mounted on deflection yoke 13. However, separator extends from a narrow-necked end 19, for fitting around tube neck 3, through a flared area 21, for fitting over tube center skirt section 5, to a large-diameter terminus 23 located at or near tube perimeter 7. Coils 15 are mounted on the outside of separator 17 and operate in the same way as when they were mounted on yoke 13 in the prior art.

Figure 4:
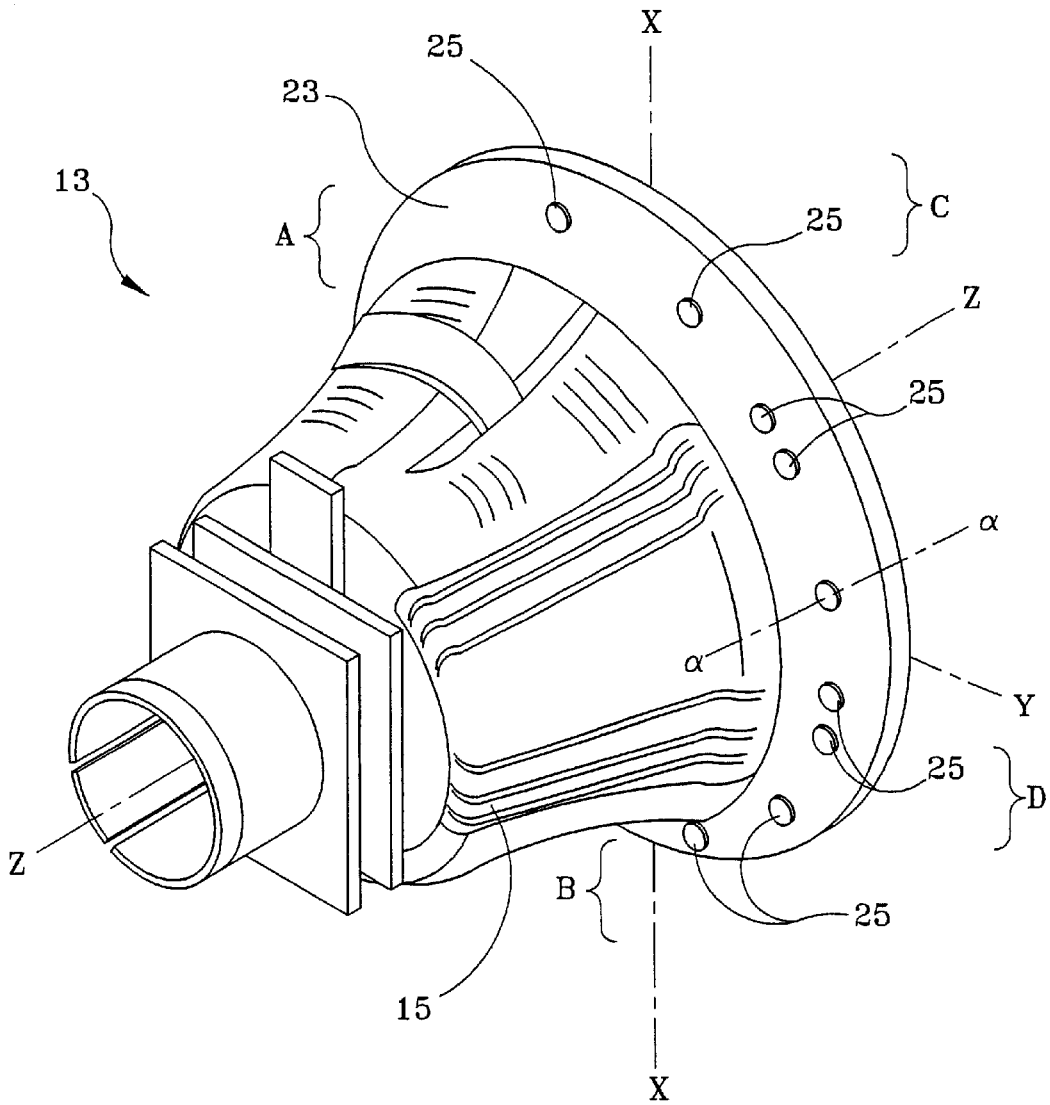
FIG. 4 is a similar view as in FIG. 3 after creation of the small mis-convergence correcting magnets formed therein.

As shown in FIG. 4, the result of this invention is the creation of a plurality of small, powerful magnetic poles 25 in separator 17. Each of magnetic 25 creates magnetic lines of flux that radiate outward from their specific location and influence the red, green and blue electron beams to adjust the convergence of them in areas remote from the center of screen 9 and about terminus 23 and insure the beams converge on the appropriate pixel or pixels to produce a reliable reproduction of what it is determined to be reproduced on the television screen. Specifically, it has been determined that magnetic poles 25 are most successful in correcting the mis-convergence of the beams if they are located at angles, measured from the "x" axis in a clockwise fashion, and selected from the group consisting of 0°, 30°, 36°, 54°, 60°, 72°, and 90° angled locations in the first quadrant "A" of the front end of separator 17 and also at their mirror reflections of opposite polarity in the other three quadrants, "B", "C", and "D" as shown in FIG. 4.

Magnetic poles 25 in terminus 23 are produced by at least one application of short-duration, high-voltage electrical pulse thereto. Preferably, the high-voltage electrical pulse lasts from a few microseconds to as much as one second and the voltage can range from less than 10 volts to as much as 10,000 volts. Quite surprisingly, magnetic poles 25, generated by this method, remain localized and do not spread or dilute throughout the rest of the magnetic-particles that fill the plastic making up separator 17. Further, these magnetic poles retain their magnetic power over a long period of time and do not have to be re-generated or reinforced throughout their lifetime.

Figure 5:
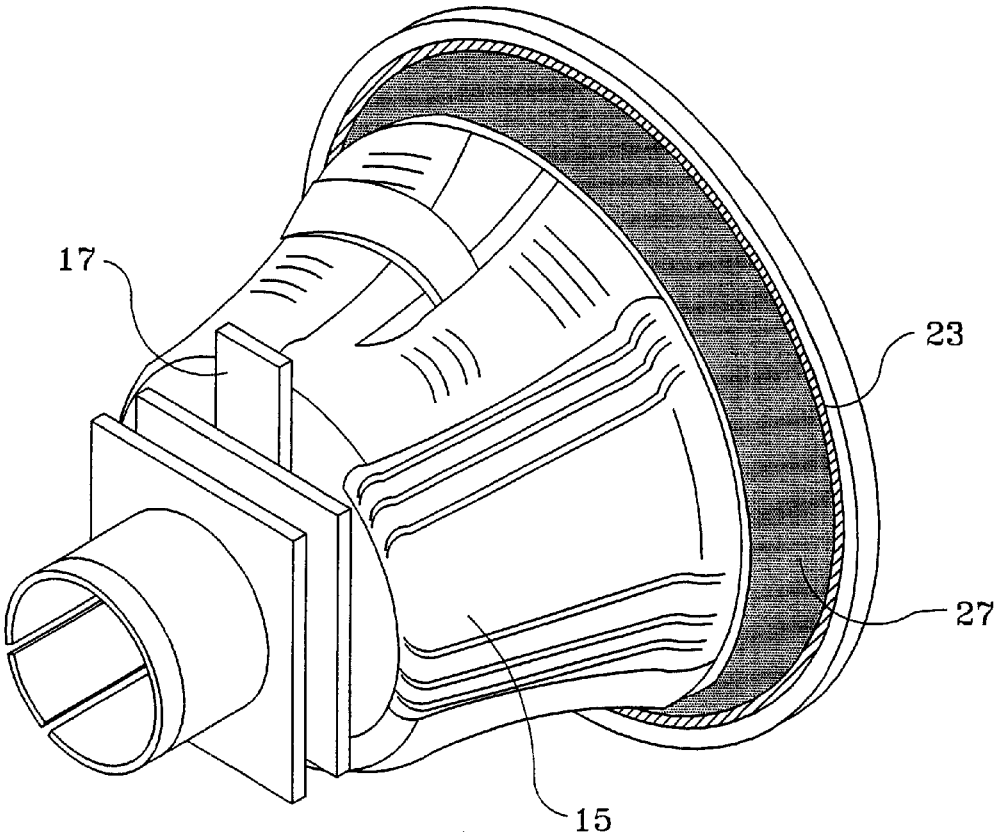
FIG. 5 is an illustrative view of another embodiment of this invention.

There are a number of ways to practice this invention. For instance, as shown in FIGS. 3 and 4, separator 17 may be made entirely of magnetic resin and the magnetic poles generated in terminus 23. Alternatively, separator 17 may be made entirely of non-magnetic resin and strips 27 of magnetic tape, containing the magnetizable particles, may be fastened by glue or other attachment means, about terminus 23 as shown in FIG. 5. Only terminus 23 of separator 17 needs to be made of the resin containing magnetizable particles while the rest of separator 17 may be made from non-magnetic particle-containing material. Further, where separator 17 is made entirely of magnetic particle-containing material, such as shown in FIG. 3, small magnetic poles 25 can be created in separator narrow-necked end 19 as well as in flared area 21 and terminus 23.

Figure 7:
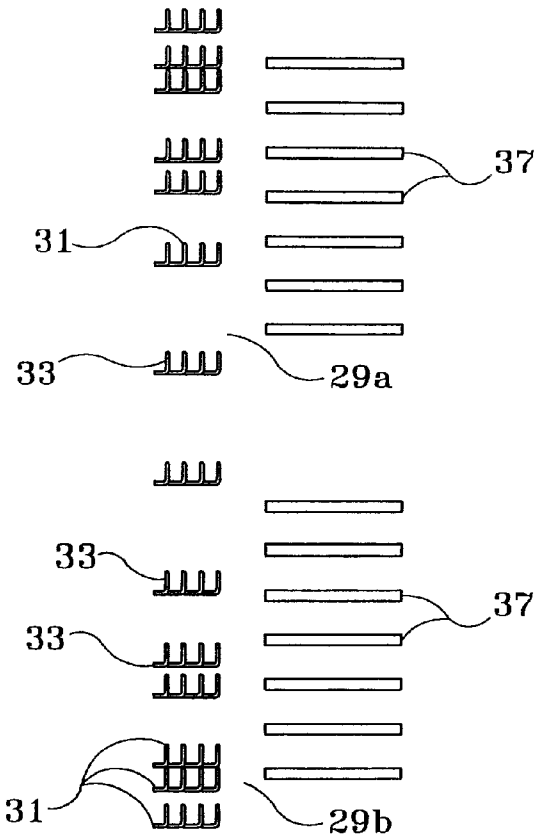
FIG. 7 is a side view of the platten shown in FIG. 6.
Figure 6:
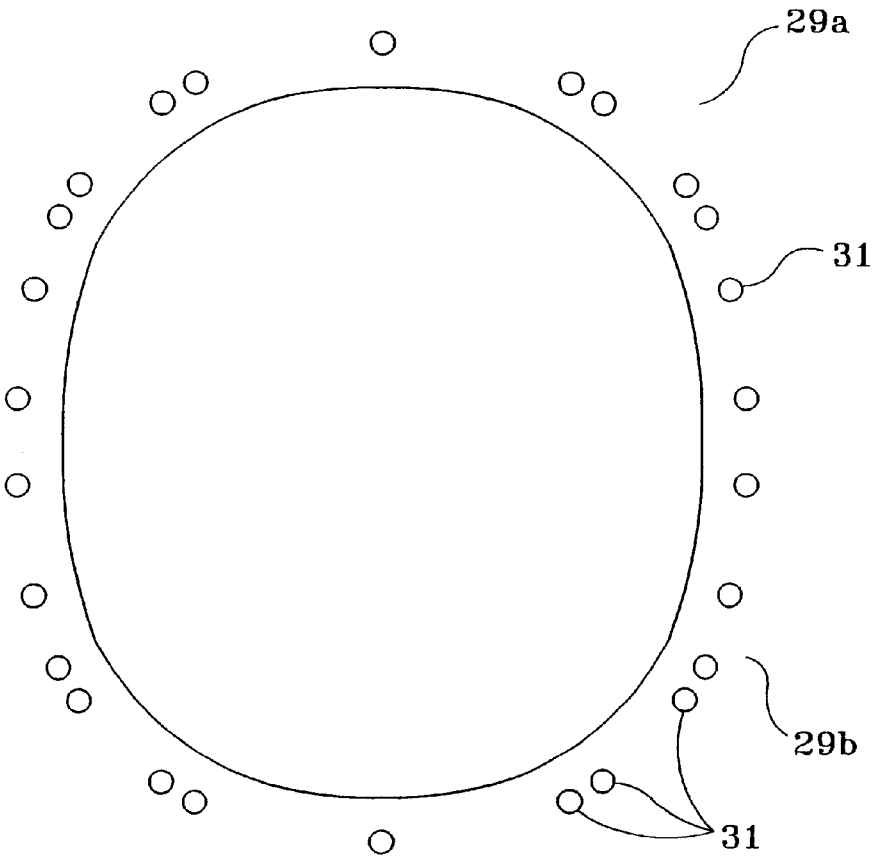
FIG. 6 is a front view of a typical platten used to form the small mis-convergence correcting magnets in the front ring of this invention.

As a non-limiting example of how to create electromagnetic poles 25 in terminus 23 of separator 17, as shown in FIGS. 6 and 7, two half-plattens 29*a* and 29*b* are used on which a plurality of individual electric coils 31 are located, each coil having one exposed end 33 capable of contacting terminus ring 23 at the appropriate angular location as aforesaid. Half-plattens 29*a* and 29*b* are designed to come together from opposite sides of terminus ring 23 and then come into contact with the rear surface 35 of terminus ring 23. Wires 37 extend from each coil 31 and pass through plattens 29*a* and 29*b* to a high voltage unit (not shown) where charges of high energy are inputted to charge each coil 31 and create a strong magnet in terminus ring 23 at the exact location of contact with coil 31.

Figure 8:
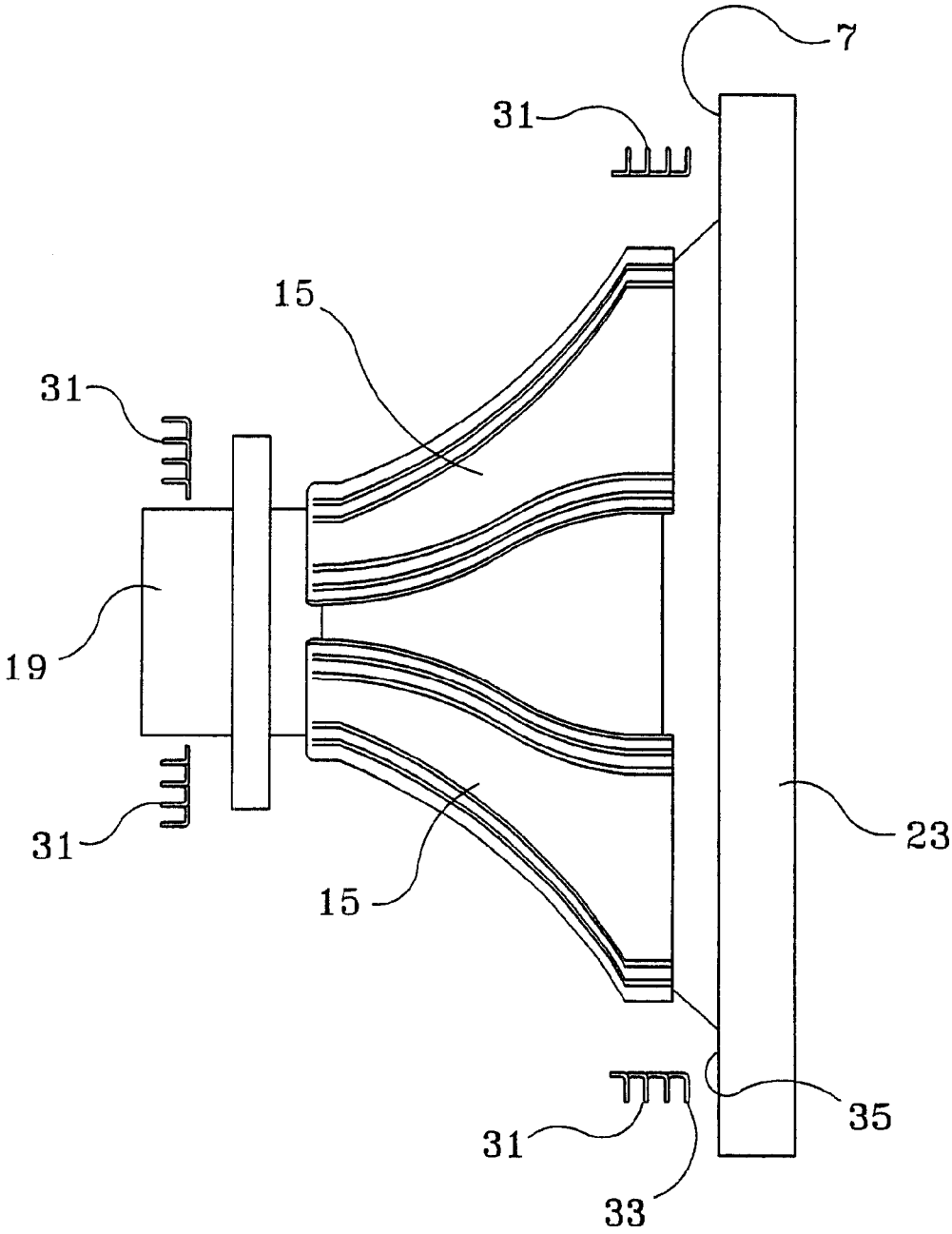
FIG. 8 is a side view of the separator of this invention showing where coils can be used to generate small electromagnetic poles.
Figure 9:
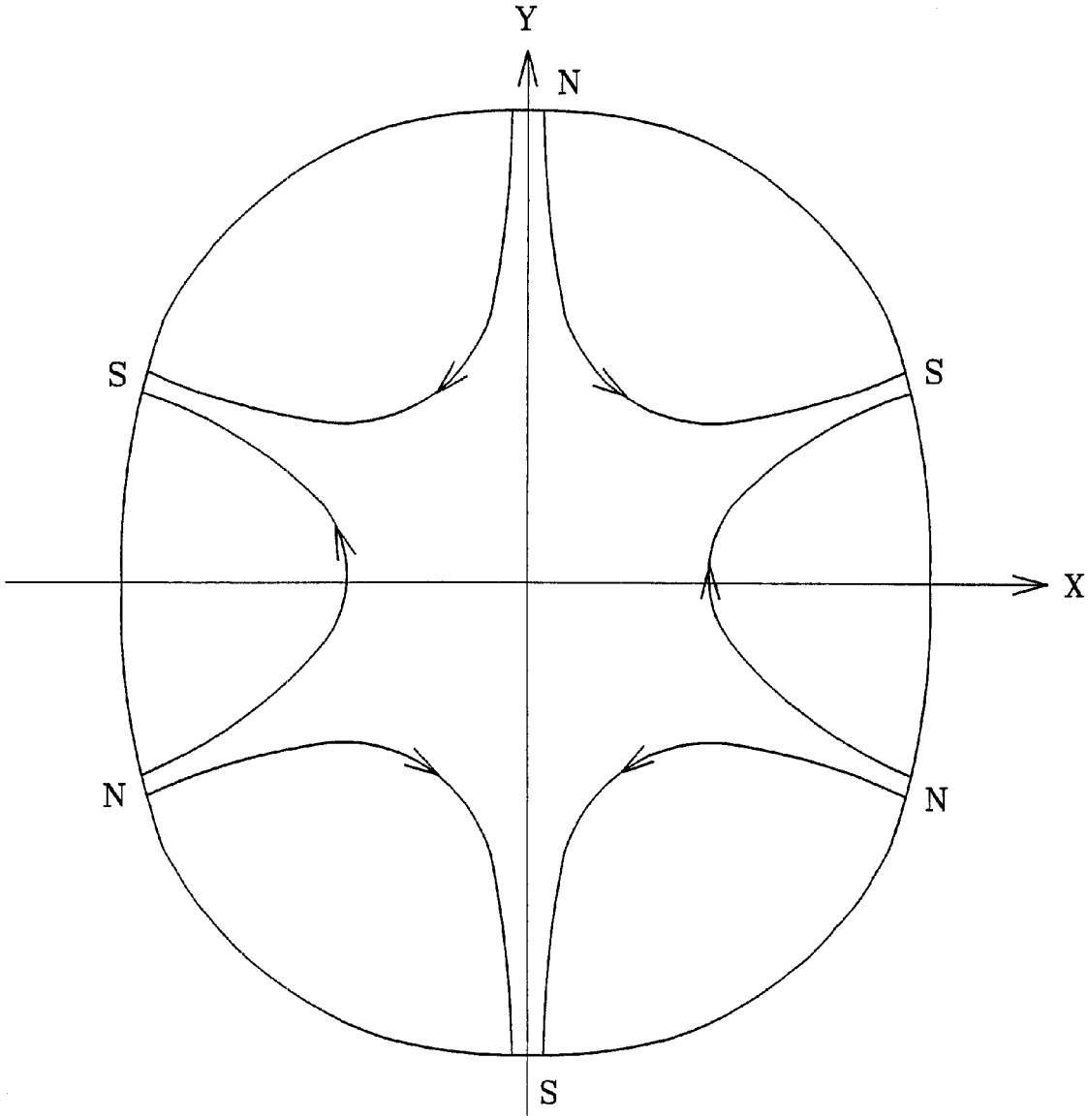
FIG. 9 is a drawing of a plane orthogonal to the "z" axis of a cathode ray tube showing how the six-pole component of the magnetic field, created by this invention, interacts within the narrow-necked section of the tube.
Figure 10:
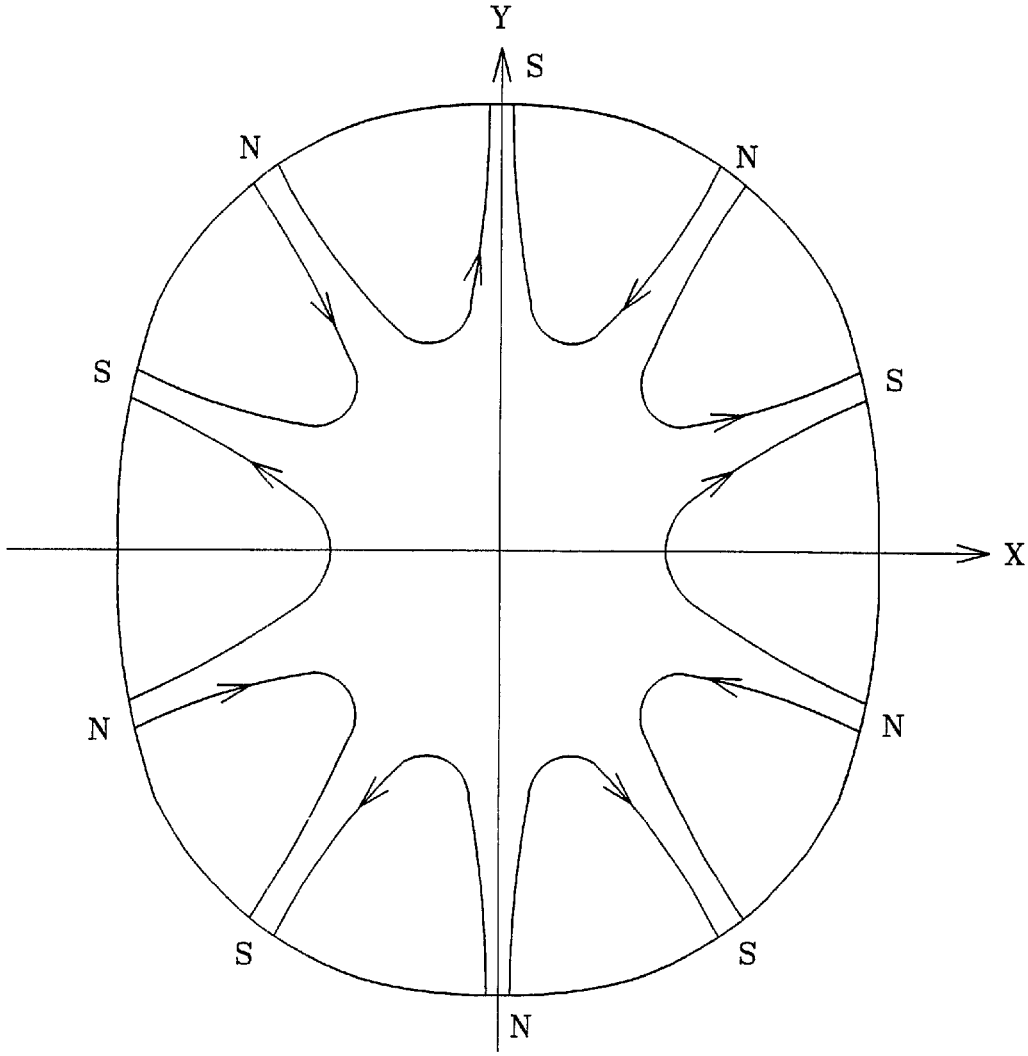
FIG. 10 is a drawing of a plane orthogonal to the "z" axis of a cathode ray tube showing how the ten-pole component of the magnetic field, created by this invention, interacts within the narrow-necked section of the tube.

In the preferred embodiment of this invention, where the entire separator 17 is made of injection-moldable plastic containing a high density of magnetizable particles as shown in FIGS. 3 and 8, electromagnets 25 are spaced thereabout, as shown in FIG. 4. As shown in FIG. 8, electric coils 31 (made in figurative form only) are used to create magnetic poles 25 at various locations over the entire surface of separator 17. As shown in FIGS. 9 and 10, magnetic poles 25 may be created about separator terminus 23 such as in six-pole and ten-pole magnetic fields respectively.

Figures 11, 12:
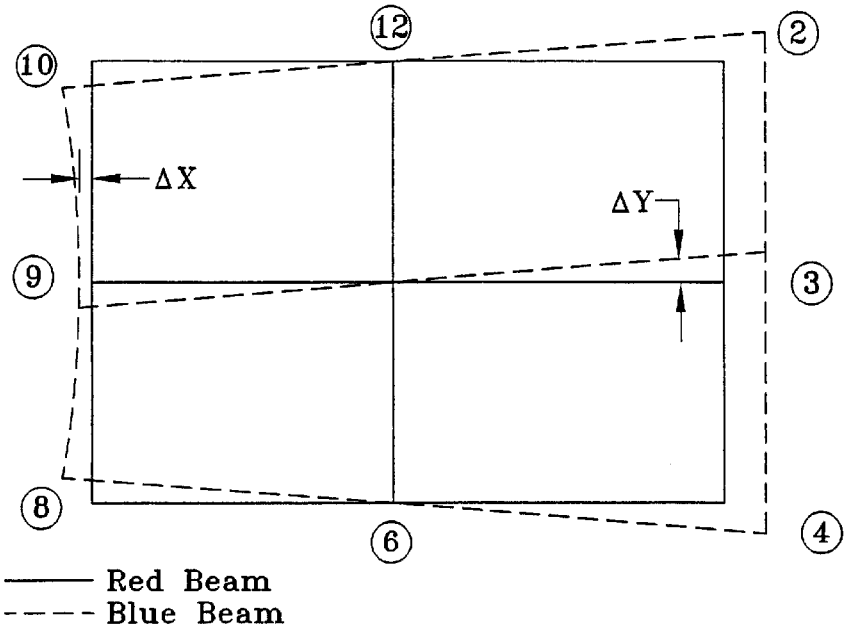
FIG. 11 is a drawing of the mis-convergence common found between red beams and blue beams in newly assembled cathode ray tubes; and, FIG. 12 is a table of typical angular pole positions used to obtain correction of blue and red errors in the screen of the cathode ray tube.

In the process of providing final correction to the convergence of the beams in tube 1, a test beam or beams are generated in the guns inside the CRT and directed to impact pixels 11 on the inside of viewing screen 9. Measurement of the mis-convergence, such as that shown for the red and blue beams, is shown in FIG. 11 and is recorded by a series of cameras or dss devices. Using an algorithm, the mis-convergence is reduced by generating magnetic poles 25 in different strengths and in different locations such as by adjusting the voltage of the charge that will be passed through electric coils 31 and into separator 17. FIG. 12 shows a table of locations of magnetic poles 25 that can be employed to achieve movement of the blue beam at location 9 in FIG. 11. Correctional movement of the beams in the "x" axis direction ($\Delta x$) requires creation of a magnetic pole 25 at location 30° in the quadrant in which the correction is required. Correctional movement of the beams in the "y" axis direction ($\Delta y$) requires creation of a magnetic pole 25 at location 36° in the quadrant in which the correction is required. In the preferred embodiment, magnetic poles 25 may be induced in various location throughout separator 17 as needed. The location and strength of each magnetic pole 25 is determined by the algorithm using the measured deviation of the beams from a desired screen format. This same inventive apparatus and inventive process is useful in the case where the CRT is monochromatic.

The process of using separator 17 begins with the step of affixing separator 17 to the fully assembled CRT, wherein at least one pair of focusing coils 15 are mounted thereon. The electron beam generating guns inside the CRT are then energized to generate the forwardly-directed electron beams to cause them to strike pixels 11 on the inside of viewing screen section 9. Focusing coils 15 are then adjusted to obtain a focused picture on screen 9. The deviation of the beams from their desired position, the lack of focus in various locations, and any washout of color on screen 9 is then observed.

Plattens 29*a* and 29*b* are then located over separator 17 with their coils 31 placed against the outer surface of separator 17 at locations, such as at 0°, 30°, 36°, 54°, 60°, 72°, and 90° in quadrants A, B, C, and D as shown in FIGS. 4 and 8–10. Application of short-duration, large-voltage electric charges are then made through plattens 29*a* and 29*b* to specific coils 31 to create local magnetic poles 25 that will correct the perceived mis-convergence throughout screen 9. Plattens 29*a* and 29*b* are then lifted way from separator 17 and tube 1 is passed on for further assembly with various electrical components and the cabinet. Note that separator 17 need not be removed and then reinstalled as is the practice in the prior art.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A device for correcting residual misconvergence errors in a cathode ray tube, the tube including a narrow-necked section, located at the rear thereof, in which electron guns mounted therein generate forwardly-directed electronic beams, an outwardly-opening center skirt section, extending forward from the narrow-necked section, and terminating in a wide perimeter surrounding a relatively flat, pixel-coated, viewing screen section that is arranged generally orthogonal to the axis of the narrow-necked section and upon which the electronic beams are directed to strike the pixels to produce images for viewing from the front of the tube, and further having at least one pair of electromagnetic coils mounted outside the tube, for initial focusing of the electron beams during their travel from the guns to the screen, said device comprising:

(a) a separator made of a plastic, said plastic including a high density of magnetizable particles therein, said separator arranged for placement about the outside of the tube and adapted to receive the electromagnetic coils thereon; and, (b) a plurality of small, powerful magnetic poles formed in said separator by at least one application of short-duration, high-voltage charges to various areas on said separator, the location of said magnetic poles determined by measuring the difference between the actual location on the viewing screen where the electron beams strike the pixels and the desired location where the beams are desired to strike the pixels and applying appropriate correction to the paths of the beams using the location and the strength of the magnetic poles.

2. The device for correcting residual mis-convergence errors in a cathode ray tube of claim 1 wherein the cathode ray tube is a colored CRT.

3. The device for correcting residual mis-convergence errors in a cathode ray tube of claim 1 wherein said magnetizable particles located in said separator are barium ferrite particles.

4. The device for correcting residual mis-convergence errors in a cathode ray tube of claim 1 wherein the tube is further defined by "x" and "y" axes passing respectively horizontally and vertically across the viewing screen of the tube and intersecting at the center of the tube, and a "z" axis extending centrally from the necked portion and intersecting the intersected "x" and "y" axis at the center of the tube and wherein said small, powerful magnetic poles are located at angles, measured from said "y" axis in a clockwise fashion, and are selected from the group consisting of 0°, 30°, 36°, 54°, 60°, 72°, and 90° locations in the first quadrant of said convergence ring and also at their mirror reflections of opposite polarity in the other three quadrants.

5. The device for correcting residual mis-convergence errors in a cathode ray tube of claim 1 wherein said separator is constructed of plastic without magnetic particles and includes a terminus portion, adjacent said perimeter section surrounding the perimeter surrounding the viewing screen of the tube, and further includes at least one layer of tape adhered to said terminus portion said tape having of high density of magnetizable particles embedded therein on which to form said plurality of small, powerful magnetic poles.

6. The device for correcting residual mis-convergence errors in a cathode ray tube of claim 1 wherein said separator is made from injection-moldable plastic having a high density of magnetizable particles embedded therein.

7. The device for correcting residual mis-convergence errors in a cathode ray tube of claim 1 wherein said plurality of small, powerful magnetic poles are formed in said separator by iteratively applied applications of short-duration, high-voltage pulses to various areas on said separator.

8. The device for correcting residual mis-convergence errors in a cathode ray tube of claim 7 wherein said pulses lasts from a few microseconds to as much as one second.

9. The device for correcting residual mis-convergence errors in a cathode ray tube of claim 7 wherein said high-voltage pulses are in a charge of less than 10 volts to as much as 10,000 volts.

10. A device for correcting residual misconvergence errors in a color cathode ray tube, the tube including a narrow-necked section, located at the rear thereof, in which electron guns mounted therein generate forwardly-directed red, blue and green electronic beams, an outwardly-opening center skirt section, extending forward from the narrow-necked section, and terminating in a wide perimeter surrounding a relatively flat, pixel-coated, viewing screen section that is arranged generally orthogonal to the axis of the narrow-necked section and upon which the electronic beams are directed to strike the pixels to produce colored images for viewing from the front of the tube, and further having at least one pair of electromagnetic coils mounted outside the tube, for initial focusing of the electron beams during their travel from the guns to the screen, said device comprising:

(a) a separator made of a plastic, said plastic including a high density of magnetizable particles therein, said separator arranged for placement about the outside of the tube and adapted to receive the electromagnetic coils thereon; and, (b) a plurality of small, powerful magnetic poles formed in said separator by at least one application of short-duration, high-voltage charges to various areas on said separator, the location of said magnetic poles determined by measuring the difference between the actual location on the viewing screen where the electron beams strike the pixels and the desired location where the beams are desired to strike the pixels and applying appropriate correction to the paths of the three color beams using the location and the strength of the magnetic poles.

11. The device for correcting residual mis-convergence errors in a color cathode ray tube of claim 10 wherein said magnetizable particles located in said separator are barium ferrite particles.

12. The device for correcting residual mis-convergence errors in a color cathode ray tube of claim 11 wherein the tube is further defined by "x" and "y" axes passing respectively horizontally and vertically across the viewing screen of the tube and intersecting at the center of the tube, and a "z" axis extending centrally from the necked portion and intersecting the intersected "x" and "y" axis at the center of the tube and wherein said small, powerful magnetic poles are located at angles, measured from said "y" axis in a clockwise fashion, and are selected from the group consisting of 0°, 30°, 36°, 54°, 60°, 72°, and 90° locations in the first quadrant of said convergence ring and also at their mirror reflections of opposite polarity in the other three quadrants.

* * * * *